US009402144B2

(12) United States Patent
Melchior et al.

(10) Patent No.: US 9,402,144 B2
(45) Date of Patent: Jul. 26, 2016

(54) APPARATUS FOR CHANGING AN AUDIO SCENE AND AN APPARATUS FOR GENERATING A DIRECTIONAL FUNCTION

(71) Applicant: IOSONO GmbH, Erfurt (DE)

(72) Inventors: Frank Melchior, Herrsching am Ammersee (DE); Robert Steffens, Niedernissa (DE); Andreas Partzsch, Erfurt (DE); Uwe Michaelis, Ilmenau (DE)

(73) Assignee: IOSONO GmbH, Erfurt (DE)

( * ) Notice: Subject to any disclaimer, the term of this patent is extended or adjusted under 35 U.S.C. 154(b) by 524 days.

(21) Appl. No.: 13/722,568

(22) Filed: Dec. 20, 2012

(65) Prior Publication Data

US 2013/0114819 A1 May 9, 2013

Related U.S. Application Data

(63) Continuation of application No. PCT/EP2011/003122, filed on Jun. 24, 2011.

(30) Foreign Application Priority Data

Jun. 25, 2010 (DE) ..... 10 2010 030 534

(51) Int. Cl.
*H04R 5/02* (2006.01)
*H04S 7/00* (2006.01)

(52) U.S. Cl.
CPC ... *H04S 7/30* (2013.01); *H04S 7/40* (2013.01); *H04S 2400/11* (2013.01); *H04S 2420/03* (2013.01)

(58) Field of Classification Search
CPC ..... G01L 19/008
USPC ..... 381/17, 18, 19, 20, 21, 22, 23, 109, 310
See application file for complete search history.

(56) References Cited

U.S. PATENT DOCUMENTS 6,572,475 B1 6/2003 Okabe et al.
8,406,439 B1 * 3/2013 Bedingfield, Sr. ..... H04M 3/56 381/310

(Continued)

FOREIGN PATENT DOCUMENTS

JP 2003284196 10/2003
WO WO-2006091540 8/2006
WO WO-2010/101880 9/2012

OTHER PUBLICATIONS

Geier, M et al., "The SoundScape Renderer: A Unified Spatial Audio Reproduction Framework for Arbitrary Rendering Methods", Presented at the 124th AES Convention. Amsterdam, The Netherlands., May 2008, 6 Pages.

(Continued)

*Primary Examiner* — Alexander Jamal
(74) *Attorney, Agent, or Firm* — Perkins Coie LLP; Michael A. Glenn

(57) ABSTRACT

An apparatus for changing an audio scene has a direction determiner and an audio scene processing apparatus. The audio scene has at least one audio object having an audio signal and associated meta data. The direction determiner determines a direction of a position of the audio object with respect to a reference point based on the meta data of the audio object. Further, the audio scene processing device processes the audio signal, a processed audio signal derived from the audio signal or the meta data of the audio object based on a determined directional function and the determined direction of the position of the audio object.

18 Claims, 8 Drawing Sheets

(56) References Cited

U.S. PATENT DOCUMENTS

| | | | | |
|---|---|---|---|---|
| 8,698,844 | B1 * | 4/2014 | Middler et al. | 345/650 |
| 2005/0105442 | A1 * | 5/2005 | Melchior et al. | 369/83 |
| 2006/0008117 | A1 | 1/2006 | Kanada et al. | |
| 2006/0133628 | A1 | 6/2006 | Trivi et al. | |
| 2006/0206221 | A1 | 9/2006 | Metcalf et al. | |
| 2008/0192965 | A1 * | 8/2008 | Strauss et al. | 381/300 |
| 2008/0232602 | A1 | 9/2008 | Shearer et al. | |

OTHER PUBLICATIONS

Pulkki, V et al., "Virtual Sound Source Positioning Using Vector Base Amplitude Panning", Journal of Audio Eng. Soc. vol. 45, No. 6., Jun. 1997, 456-466.

* cited by examiner

APPARATUS FOR CHANGING AN AUDIO SCENE AND AN APPARATUS FOR GENERATING A DIRECTIONAL FUNCTION

CROSS-REFERENCE TO RELATED APPLICATIONS

This application is a continuation of copending International Application No. PCT/EP2011/003122, filed Jun. 24, 2011, which is incorporated herein by reference in its entirety, and additionally claims priority from German Application No. 102010030534.0, filed Jun. 25, 2010, which is incorporated herein by reference in its entirety.

BACKGROUND OF THE INVENTION

Embodiments according to the invention relate to processing audio scenes and in particular to an apparatus and a method for changing an audio scene and an apparatus and a method for generating a directional function.

The production process of audio content consists of three important steps: recording, mixing and mastering. During the recording process, the musicians are recorded and a large number of separate audio files are generated. In order to generate a format, which can be distributed, these audio data are combined to a standard format, like stereo or 5.1 surround. During the mixing process, a large number of processing devices are involved in order to generate the desired signals, which are played back over a given speaker system. After mixing the signals of the musicians, these can no longer be separated or processed separately. The last step is the mastering of the final audio data format. In this step, the overall impression is adjusted or, when several sources are compiled for a single medium (e.g. CD), the characteristics of the sources are matched during this step.

In the context of channel-based audio representation, mastering is a process processing the final audio signals for the different speakers. In comparison, in the previous production step of mixing, a large number of audio signals are processed and processed in order to achieve a speaker-based reproduction or representation, e.g. left and right. In the mastering stage, only the two signals left and right are processed. This process is important in order to adjust the overall balance or frequency distribution of the content.

In the context of an object-based scene representation, the speaker signals are generated on the reproduction side. This means, a master in terms of speaker audio signals does not exist. Nevertheless, the production step of mastering is required to adapt and optimize the content.

Different audio effect processing schemes exist which extract a feature of an audio signal and modify the processing stage by using this feature. In "Dynamic Panner: An Adaptive Digital Audio Effect for Spatial Audio, Morrell, Martin; Reis, Joshua presented at the 127$^{th}$ AES Convention, 2009", a method for automatic panning (acoustically placing a sound in the audio scene) of audio data using the extracted feature is described. Thereby, the features are extracted from the audio stream. Another specific effect of this type has been published in "Concept, Design, and Implementation of a General Dynamic Parametric Equalizer, Wise, Duane K., JAES Volume 57 Issue ½ pp. 16-28; January 2009". In this case, an equalizer is controlled by features extracted from an audio stream. With regard to the object-based scene description, a system and a method have been published in "System and method for transmitting/receiving object-based audio, Patent application US 2007/0101249". In this document, a complete content chain for object-based scene description has been disclosed. Dedicated mastering processing is disclosed, for example, in "Multichannel surround sound mastering and reproduction techniques that preserve spatial harmonics in three dimensions, Patent application US2005/0141728". This patent application describes the adaptation of a number of audio streams to a given loudspeaker layout by setting the amplifications of the loudspeaker and the matrix of the signals.

Generally, flexible processing, in particular of object-based audio content, is desirable for changing audio scenes or for generating, processing or amplifying audio effects.

SUMMARY

According to an embodiment, an apparatus for changing an audio scene, the audio scene having at least one audio object having an audio signal and associated meta data, may have: a direction determiner implemented to determine a direction of a position of the audio object with respect to a reference point based on the meta data of the audio object; an audio scene processing apparatus implemented to process the audio signal, a processed audio signal derived from the audio signal or the meta data of the audio object based on a determined directional function and the determined direction of the audio object to obtain a direction-dependent amplification or suppression of a parameter of the meta data to be changed, the audio signal or the processed audio signal derived from the audio signal; a control signal determiner, which is implemented to determine a control signal for controlling the audio scene processing apparatus based on the determined position and the determined directional function; and a parameter selector that is implemented to select a parameter to be changed from the meta data of the audio object or a scene description of the audio scene, wherein the control signal determiner is implemented to apply the determined directional function based on the determined direction of the audio object to the parameter to be changed in order to determine the control signal, wherein the directional function defines a weighting factor for different directions of a position of an audio object, which indicates how heavily the audio signal, a processed audio signal derived from the audio signal or a parameter of the meta data of the audio object, which is in the determined direction with respect to the reference point, is changed.

According to another embodiment, an apparatus for generating a directional function may have: a graphical user interface having a plurality of input knobs arranged in different directions with respect to a reference point, wherein a distance of each input knob of the plurality of input knobs from the reference point can be individually adjusted, wherein the distance of an input knob from the reference point determines a value of the directional function in the direction of the input knob; and a directional function determiner implemented to generate the directional function based on the distances of the plurality of input knobs from the reference point, such that a physical quantity can be influenced by the directional function, wherein the directional function determiner is implemented to calculate further functional values of the directional function by interpolating functional values obtained based on the distances of the plurality of input knobs.

According to another embodiment, an apparatus for changing an audio scene as mentioned above may have an apparatus for generating a directional function as mentioned above, wherein the apparatus for generating a directional function provides the determined directional function.

According to another embodiment, a method for changing an audio scene, the audio scene having at least one audio object having an audio signal and associated meta data, may have the steps of determining a direction of a position of the audio object with respect to a reference point based on the meta data of the audio object; processing the audio signal, a processed audio signal derived from the audio signal or the meta data of the audio object based on a determined directional function and the determined direction of the position of the audio object to obtain a direction-dependent amplification or suppression of a parameter of the meta data to be changed, the audio signal or the processed audio signal derived from the audio signal; determining a control signal for controlling the audio scene processing apparatus based on the determined position and the determined directional function; and selecting a parameter to be changed from the meta data of the audio object or a scene description of the audio scene, wherein the control signal determiner is implemented to apply the determined directional function based on the determined direction of the audio object to the parameter to be changed in order to determine the control signal, wherein the directional function defines a weighting factor for different directions of a position of an audio object, which indicates how heavily the audio signal, a processed audio signal derived from the audio signal or a parameter of the meta data of the audio object, which is in the determined direction with respect to the reference point, is changed.

According to another embodiment, a method for generating a directional function may have the steps of providing a graphical user interface having a plurality of input knobs arranged in different directions with respect to a reference point, wherein a distance of every input knob of the plurality of input knobs from the reference point can be individually adjusted, wherein the distance of an input knob from the reference point determines a value of the directional function in the direction of the input knob; calculating further functional values of the directional function by interpolating functional values obtained based on the distances of the plurality of input knobs; and generating the directional function based on the distances of the plurality of input knobs from the reference point, such that a physical quantity can be influenced by the directional function.

Another embodiment may have a computer program having a program code for performing one of the methods mentioned above, when the computer program runs on a computer or microcontroller.

An embodiment according to the invention provides an apparatus for changing an audio scene comprising a direction determiner and an audio scene processing apparatus. The audio scene comprises at least one audio object comprising an audio signal and the associated meta data. The direction determiner is implemented to determine a direction of the position of the audio object with respect to a reference point based on the meta data of the audio object. Further, the audio scene processing apparatus is implemented to process the audio signal, a processed audio signal derived from the audio signal or the meta data of the audio object based on a determined directional function and the determined direction of the position of the audio object.

Embodiments according to the invention are based on the basic idea of changing an audio scene in dependence on the direction with respect to a reference point based on a directional function to allow fast, uncomplicated and flexible processing of such audio scenes. Therefore, first, a direction of a position of the audio object with respect to the reference point is determined from the meta data. Based on the determined direction, the directional function (e.g. direction-dependent amplification or suppression) can be applied to a parameter of the meta data to be changed, to the audio signal or to a processed audio signal derived from the audio signal. Using a directional function allows flexible processing of the audio scene. Compared to known methods, the application of a directional function can be realized faster and/or with less effort.

Several embodiments according to the invention relate to an apparatus for generating a directional function comprising a graphical user interface and a directional function determiner. The graphical user interface comprises a plurality of input knobs arranged in different directions with respect to a reference point. A distance of each input knob of the plurality of input knobs from the reference point is individually adjustable. Further, the distance of an input knob from the reference point determines a value of the directional function in the direction of the input knob. Further, the directional function determiner is implemented to generate the directional function based on the distances of the plurality of input knobs from the reference point, such that a physical quantity can be influenced by the directional function.

Optionally, the apparatus for generating a directional function can also comprise a modifier modifying the physical quantity based on the directional function.

Further embodiments according to the invention relate to an apparatus for changing an audio scene having an apparatus for generating a directional function. The apparatus for generating a directional function determines the directional function for the audio scene processing apparatus of the apparatus for changing an audio scene.

BRIEF DESCRIPTION OF THE DRAWINGS

Embodiments according to the invention will be discussed below with reference to the accompanying drawings. They show.

DETAILED DESCRIPTION OF THE INVENTION

In the following, partly, the same reference numbers are used for objects and functional units having the same or similar functional characteristics. Further, optional features of the different embodiments can be combined or exchanged with one another.

Figure 1:
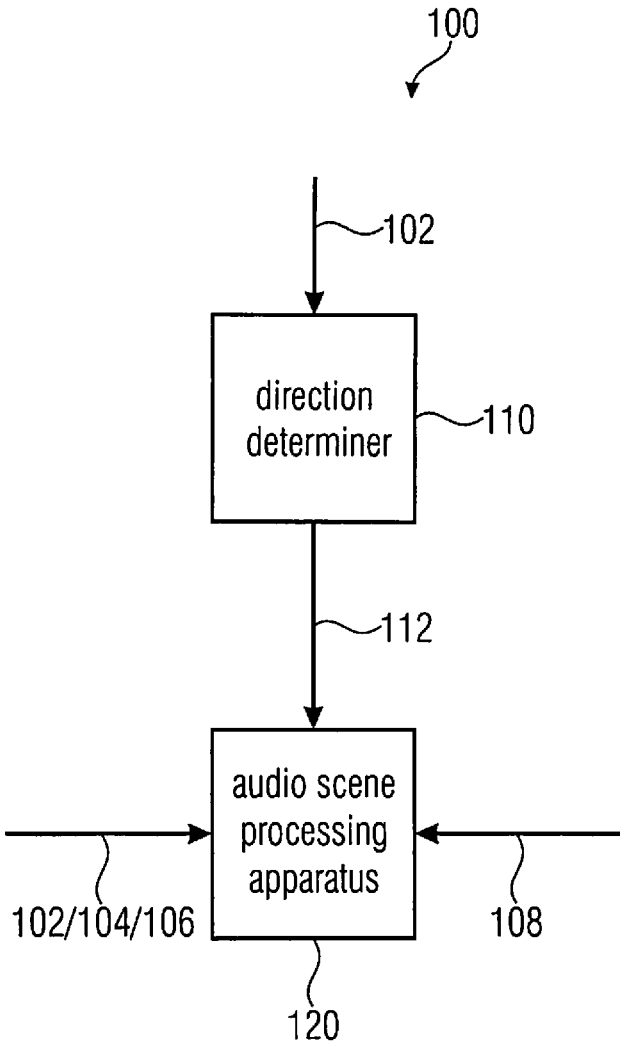
FIG. 1 a block diagram of an apparatus for changing an audio scene.

FIG. 1 shows a block diagram of an apparatus 100 for changing an audio scene, corresponding to an embodiment of the invention. The audio scene includes at least one audio object comprising an audio signal 104 and associated meta data 102. The apparatus 100 for changing an audio scene includes a direction determiner 110 connected to an audio scene processing apparatus 120. The direction determiner 110 determines a direction 112 of a position of the audio object with respect to a reference point based on the meta data 102 of the audio object. Further, the audio scene processing apparatus 120 processes the audio signal 104, a processed audio signal 106 derived from the audio signal 104 or the meta data 102 of the audio object based on a determined directional function 108 and the determined direction 112 of the position of the audio object.

By processing the audio signal 104, a processed audio signal 106 derived from the audio signal 104 or the meta data 102 of the audio object based on the determined directional function 108, a very flexible option for changing the audio scene can be realized. For example, already by determining very few points of the directional function and optional interpolation of intermediate points, a significant directional dependency of any parameters of the audio object can be obtained. Correspondingly, fast processing with little effort and high flexibility can be obtained.

The meta data 102 of the audio object can include, for example, parameters for a two-dimensional or three-dimensional position determination (e.g. Cartesian coordinates or polar coordinates of a two-dimensional or three-dimensional coordinate system). Based on these position parameters, the direction determiner 110 can determine a direction in which the audio object is located with respect to the reference point during reproduction by a loudspeaker array. The reference point can, for example, be a reference listener position or generally the zero point of the coordinate system underlying the position parameters. Alternatively, the meta data 102 can already include the direction of the audio object with respect to a reference point, such that the direction determiner 110 only has to extract the same from the meta data 102 and can optionally map them to another reference point. Without limiting the universality, in the following, a two-dimensional position description of the audio object by the meta data is assumed.

The audio scene processing apparatus 120 changes the audio scene based on the determined directional function 108 and the determined direction 112 of the position of the audio object. Thereby, the directional function 108 defines a weighting factor, for example for different directions of a position of an audio object, which indicates how heavily the audio signal 104, a processed audio signal 106 derived from the audio signal 104, or a parameter of the meta data 102 of the audio object, which is in the determined direction with respect to the reference point, is changed. For example, the volume of audio objects can be changed depending on the direction. To do this, either the audio signal 104 of the audio object and/or a volume parameter of the meta data 102 of the audio object can be changed. Alternatively, loudspeaker signals generated from the audio signal of the audio object corresponding to the processed audio signals 106 derived from the audio signal 104 can be changed. In other words, a processed audio signal 106 derived from the audio signal 104 can be any audio signal obtained by processing the original audio signal 104. These can, for example, be loudspeaker signals that have been generated based on the audio signal 104 and the associated meta data 102, or signals that have been generated as intermediate stages for generating the loudspeaker signals. Thus, processing by the audio scene processing apparatus 120 can be performed before, during or after audio rendering (generating loudspeaker signals of the audio scene).

The determined directional function 108 can be provided by a memory medium (e.g. in the form of a lookup table) or from a user interface.

Figure 2A:
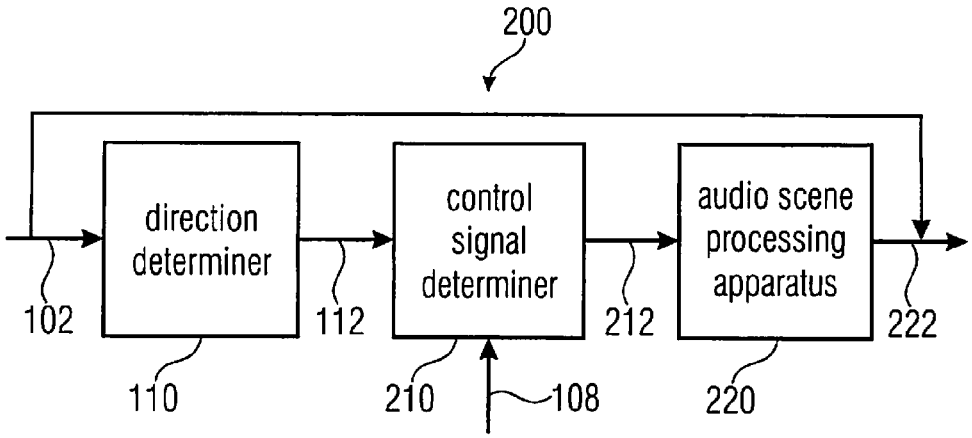
FIGS. 2*a*,2*b*,2*c* further block diagrams of apparatuses for changing an audio scene.
Figure 2B:
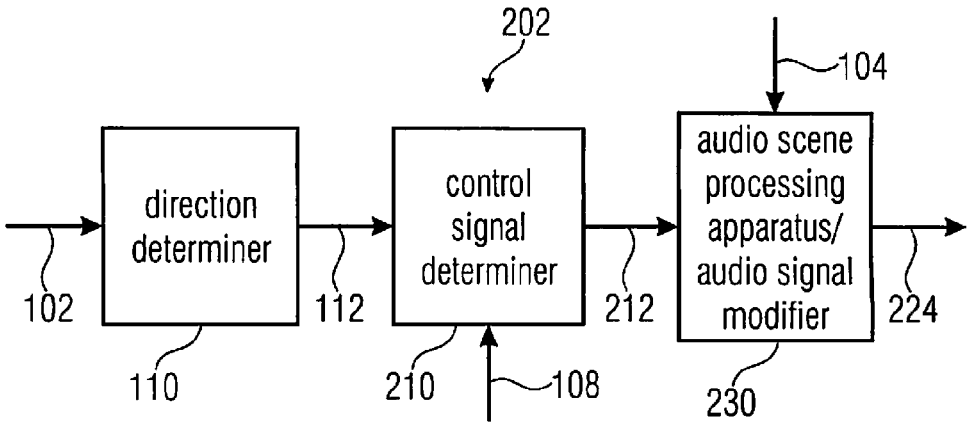
Figure 2C:
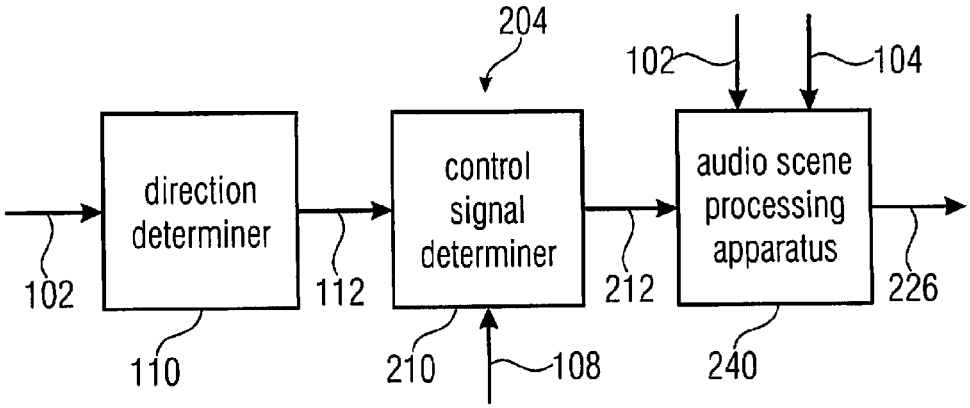

Consistent with the mentioned options of processing audio scenes, FIGS. 2*a*, 2*b* and 2*c* show block diagrams of apparatuses 200, 202, 204 for changing an audio scene as embodiments. Thereby, every apparatus 200, 202, 204 for changing the audio scene comprises, besides the direction determiner 110 and the audio scene processing apparatus 120, a control signal determiner 210. The control signal determiner 210 determines a control signal 212 for controlling the audio scene processing apparatus 120, based on the determined position 112 and the determined directional function 108. The direction determiner 110 is connected to the control signal determiner 210 and the control signal determiner 210 is connected to the audio scene processing apparatus 120.

FIG. 2*a* shows a block apparatus of an apparatus 200 for changing an audio scene, where the audio scene processing apparatus 120 comprises a meta data modifier 220 changing a parameter of the meta data 102 of the audio object based on the control signal 212. Thereby, a modified scene description is generated in the form of changed meta data 222, which can be processed by a conventional audio renderer (audio rendering apparatus), for generating loudspeaker signals. Thereby, the audio scene can be changed independently of the later audio processing. Thereby, the control signal 212 can, for example, correspond to the new parameter value exchanged against the old parameter value in the meta data 102, or the control signal 212 can correspond to a weighting factor multiplied by the original parameter or added to (or subtracted from) the original parameter.

Based on the position parameters of the meta data 102, the direction determiner 110 can calculate the direction of the position of the audio object. Alternatively, the meta data 102 can already include a direction parameter such that the direction parameter 110 only has to extract the same from the meta data 102. Optionally, the direction determiner 110 can also consider that the meta data 102 possibly relate to another reference point than the apparatus 100 for changing an audio scene.

Alternatively, an apparatus 202 for changing an audio scene can comprise an audio scene processing apparatus having an audio signal modifier 230 as shown in FIG. 2*b*. In this case, not the meta data 102 of the audio object but the audio signal 104 of the audio object is changed. To do this, the audio signal modifier 230 changes the audio signal 104 based on the control signal 212. The processed audio signal 224 can then again be processed with the associated meta data 102 of the audio object by a conventional audio renderer to generate loudspeaker signals. For example, the volume of the audio signal 104 can be scaled by the control signal 212, or the audio signal 104 can be processed in a frequency-dependent manner.

Generally, by frequency-dependent processing, in directions determined by the determined directional function 108, high or low frequencies or a predefined frequency band can be amplified or attenuated. To do this, the audio scene processing apparatus 120 can, for example, comprise a filter changing its filter characteristic based on the determined directional function 108 and the direction 112 of the audio object.

Alternatively, for example, both meta data 102 of the audio object and the audio signal 104 of the audio object can be processed. In other words, the audio scene processing apparatus 120 can include a meta data modifier 220 and an audio signal modifier 230.

A further option is shown in FIG. 2*c*. The apparatus 204 for changing an audio scene includes an audio scene processing apparatus 240 generating a plurality of loudspeaker signals 226 for reproducing the changed audio scene by a loudspeaker array based on the audio signal 104 of the audio object, the meta data 102 of the audio object and the control signal 212. In this context, the audio scene processing apparatus 240 can also be referred to as audio renderer (audio rendering apparatus). Changing the audio scene is performed during or after generating the loudspeaker signals. In other words, a processed audio signal derived from the audio signal 104 is processed in the form of the loudspeaker signals or in the form of an intermediate signal or auxiliary signal used for generating the loudspeaker signals.

In this example, the audio scene processing apparatus 120 can, for example, be a multi-channel renderer, a wave-field synthesis renderer or a binaural renderer.

Thus, the described concept can be applied before, during or after generating the loudspeaker signals for reproduction by a loudspeaker array for changing the audio scene. This emphasizes the flexibility of the described concept.

Further, not only can every audio object of the audio scene be processed individually in a direction-dependent manner by the suggested concept, but also cross-scene processing of all audio objects of the audio scene or all audio objects of an audio object group of the audio scene can take place. Dividing the audio object into audio object groups can be performed, for example, by a specially provided parameter in the meta data, or dividing can be preformed based, for example, on audio object types (e.g. point source or plane wave).

Additionally, the audio scene processing apparatus 120 can have an adaptive filter whose filter characteristic can be changed by the control signal 212. Thereby, a frequency-dependent change of the audio scene can be realized.

Figure 3:
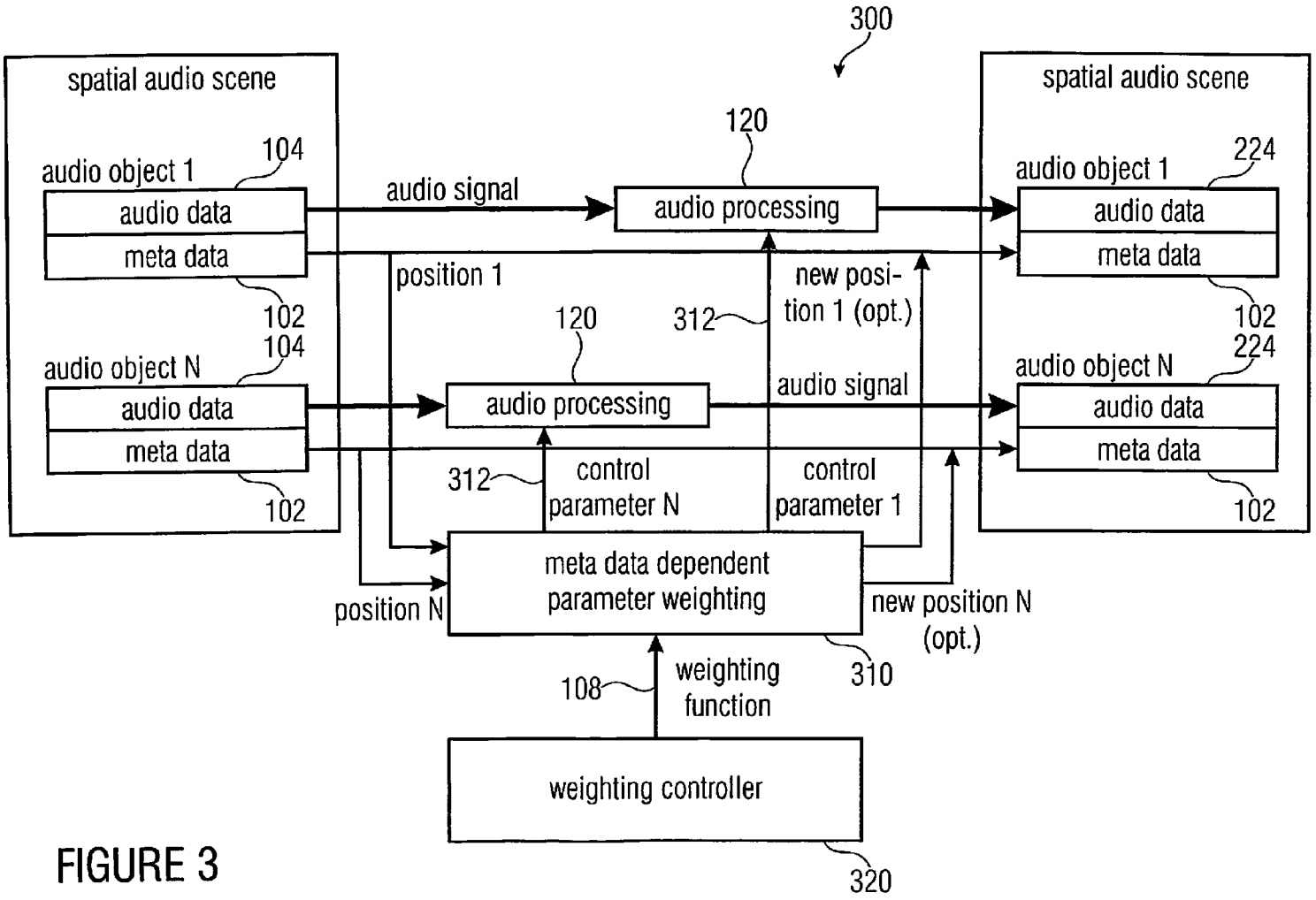
FIG. 3 a block diagram of a further apparatus for changing an audio scene.

FIG. 3 shows a further block diagram of an apparatus 300 for changing an audio scene corresponding to an embodiment of the invention. The apparatus 300 for changing an audio scene includes a direction determiner 110 (not shown), an audio scene processing apparatus 120, a control signal determiner 310, also called meta data-dependent parameter weighting apparatus, and a weighting controller 320, also called directional controller. The apparatus 300 for changing the audio scene can comprise an audio scene processing apparatus 120 for every audio object of the audio scene (in this example also called spatial audio scene) as shown in FIG. 3, or can comprise only one audio scene processing apparatus 120 processing all audio objects of the audio scene in parallel, partly in parallel or serially. The directional controller 320 is connected to the control signal determiner 310, and the control signal determiner 310 is connected to the audio scene processing apparatus 120. The direction determiner 110, not shown, determines the directions of the audio objects from the position parameters of the meta data 102 of the audio objects (1 to N) with respect to the reference point and provides the same to the control signal determiner 310. Further, the directional controller 320 (weighting controller, apparatus for generating a directional function) generates a directional function 108 (or weighting function) and provides the same to the control signal determiner 310. The control signal determiner 310 determines, based on the determined directional function 108 and the determined positions for each audio object, a control signal 312 (e.g. based on control parameters) and provides the same to the audio scene processing apparatus 120. Optionally, the control signal determiner 310 can also determine a new position of the audio object and change the same correspondingly in the meta data 102. By the audio scene processing apparatuses 120, the audio data 104 (audio signals) of the audio objects can be processed based on the control signal 312 and modified audio data 224 can be provided.

Figure 4:
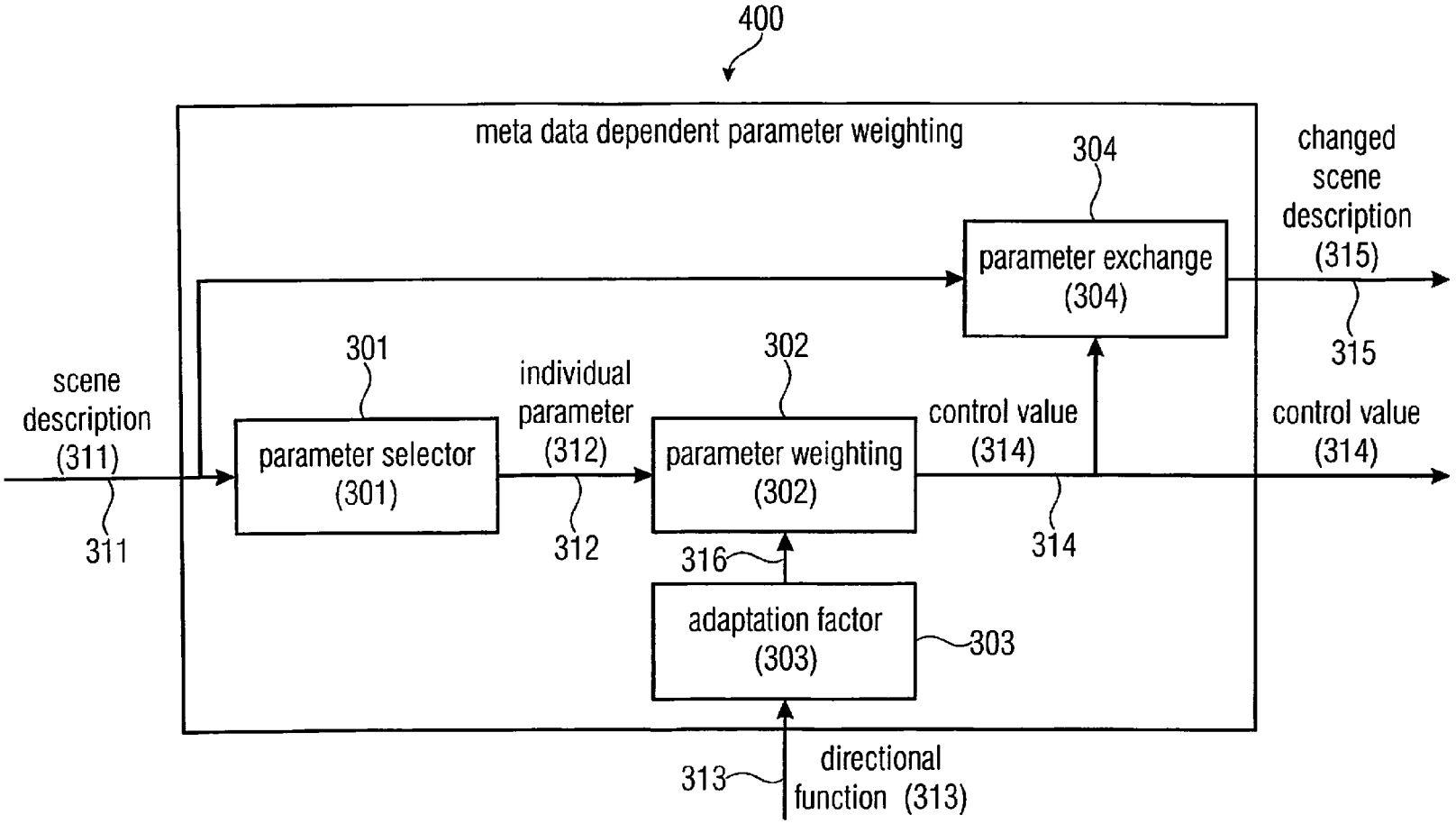
FIG. 4 a block diagram of an apparatus for changing an audio scene.

Correspondingly, FIG. 4 shows an example of a control signal determiner 400 for meta data-dependent parameter weighting. The control signal determiner 400 includes a parameter selector 301, a parameter weighting apparatus 302 and a directional function adapter 303 as well as, optionally, a meta data modifier 304. The parameter selector 301 and the directional function adapter 303 are connected to the parameter weighting apparatus 302, and the parameter weighting apparatus 302 is connected to the meta data modifier 304.

The parameter selector 301 selects a parameter from the meta data of the audio object or a scene description 311 of the audio scene, which is to be changed. The parameter to be changed can, for example, be the volume of the audio object, a parameter of a Hall effect, or a delay parameter. The parameter selector 301 provides this individual parameter 312 or also several parameters to the parameter weighting apparatus 302. As shown in FIG. 4, the parameter selector 301 can be part of the control signal determiner 400.

With the help of the parameter weighting apparatus 302, the control signal determiner 400 can apply the determined directional function based on the direction of the audio object determined by the direction determiner (not shown in FIG. 4) to the parameter 312 to be changed (or the plurality of parameters to be changed) to determine the control signal 314.

The control signal 314 can include changed parameters for a parameter exchange in the meta data or the scene description 311 or a control parameter or a control value 314 for controlling an audio scene processing apparatus as described above.

The parameter exchange in the meta data or the scene description 311 can be performed by the optional meta data modifier 304 of the control signal determiner 400, or, as described in FIG. 2*a*, by a meta data modifier of the audio data processing apparatus. Thereby, the meta data modifier 304 can generate a changed scene description 315.

The directional function adapter 303 can adapt a range of values of the determined directional function to a range of values of the parameter to be changed. With the help of the parameter weighting apparatus 302, the control signal determiner 400 can determine the control signal 314 based on the adapted directional function 316. For example, the determined directional function 313 can be defined such that its range of values varies between 0 and 1 (or another minimum and maximum value). If this range of values would be applied, for example, to the volume parameter of an audio object, the same could vary between zero and a maximum volume. However, it can also be desirable that the parameter to be changed can only be changed in a certain range. For example, the volume is only to be changed by a maximum of +/−20%. Then, the exemplarily mentioned range of values between 0 and 1 can be mapped to the range of values between 0.8 and 1.2, and this adapted directional function can be applied to the parameter 312 to be changed.

By the realization shown in FIG. 4, the control signal determiner 400 can realize meta data-dependent parameter weighting. Thereby, in an object-based scene description, specific parameters of audio objects can be stored. Such parameters consist, for example, of the position or direction of an audio source (audio object). These data can be either dynamic or static during the scene. These data can be processed by the meta data-dependent parameter weighting (MDDPW) by extracting a specific set of meta data and generating a modified set as well as a control value for an audio processing unit. FIG. 4 shows a detailed block diagram of the meta data-dependent parameter weighting.

The meta data-dependent parameter weighting receives the scene description 311 and extracts a single (or several) parameter(s) 312 using the parameter selector 301. This selection can be made by a user or can be given by a specific fixed configuration of the meta data-dependent parameter weighting. In an embodiment, this can be the azimuth angle $\alpha$. A directional function 313 is given by the directional controller which can be scaled or adapted by the adaptation factor 303 and can be used for generating a control value 314 by the parameter weighting 302. The control value can be used to control specific audio processing and to change a parameter in the scene description using the parameter exchange 304. This can result in a modified scene description.

An example for the modification of the scene description can be given by considering the parameter value of an audio source. In this case, the azimuth angle of a source is used to scale the stored volume value of the scene description in dependence on the directional function. In this scenario, audio processing is performed on the rendering side. An alternative implementation can use an audio processing unit (audio scene processing apparatus) to modify the audio data directly in dependence on the necessitated volume. Thus, the volume value in the scene description does not have to be changed.

The direction determiner 110, the audio scene processing apparatus 120, the control signal determiner 210, the meta data modifier 220, the audio signal modifier 230, the parameter selector 301 and/or the directional function adapter 303 can be, for example, independent hardware units or part of a computer, microcontroller or digital signal processor as well as computer programs or software products for execution on a microcontroller, computer or digital signal processor.

Figure 5:
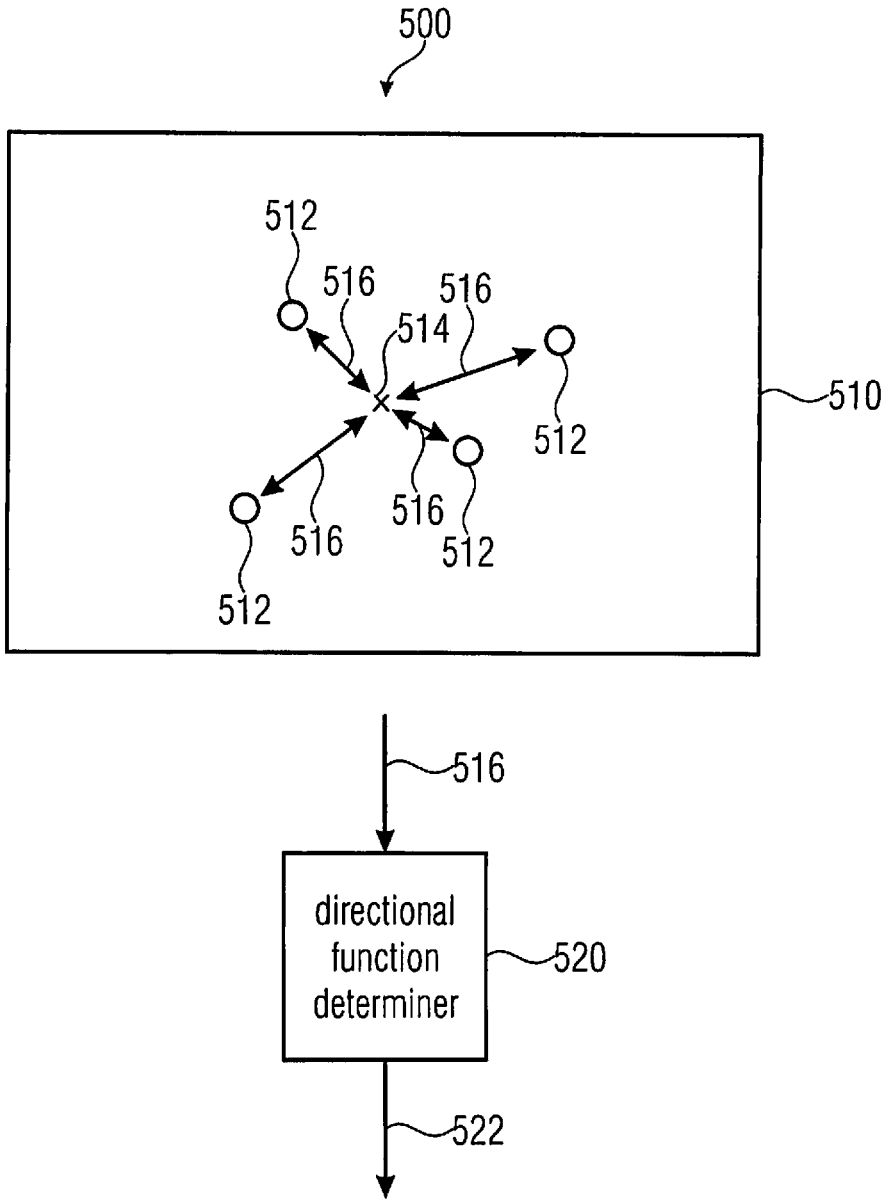
FIG. 5 a schematic illustration of an apparatus for generating a directional function.

Several embodiments of the invention are related to an apparatus for generating a directional function. To this end, FIG. 5 shows a schematic illustration of an apparatus 500 for generating a directional function 522 corresponding to an embodiment of the invention. The apparatus 500 for generating a directional function 522 includes a graphical user interface 510 and a directional function determiner 520. The graphical user interface 510 comprises a plurality of input knobs 512 arranged in different directions with respect to a reference point 514. A distance 516 of each input knob 512 of the plurality of input knobs 512 from the reference point 514 is individually adjustable. The distance 516 of an input knob 512 from the reference point 514 determines a value of the directional function 522 in the direction of the input knob 512. Further, the directional function determiner 520 generates the directional function 522 based on the distances 516 of the plurality of input knobs 512 from the reference point 514, such that a physical quantity can be influenced by the directional function 522.

The described apparatus 500 can generate a directional function based on a few pieces of information (setting the distances and, optionally, directions of the input knobs) to be input. This allows simple, flexible, fast and/or user-friendly input and generation of a directional function.

The graphical user interface 510 is, for example, a reproduction of the plurality of input knobs 512 and the reference point 514 on a screen or by a projector. The distance 516 of the input knobs 512 and/or the direction with respect to the reference point 514 can be changed, for example, with an input device (e.g. a computer mouse). Alternatively, inputting values can also change the distance 516 and/or the direction of an input knob 512. The input knobs 512 can be arranged, for example, in any different directions or can be arranged symmetrically around the reference point 514 (e.g. with four knobs they can each be apart by 90° or with six knobs they can each be apart by 60°).

The directional function determiner 520 can calculate further functional values of the directional function, for example by interpolation of functional values obtained based on the distances 516 of the plurality of input knobs 512. For example, the directional function determiner can calculate directional function values in distances of 1°, 5°, 10° or in a range between distances of 0.1° and 20°. The directional function 522 is then illustrated, for example, by the calculated directional function values. The directional function determiner can, for example, linearly interpolate between the directional function values obtained by the distances 516 of the plurality of input knobs 512. However, in the directions where the input knobs 512 are arranged, this can result in discontinuous changes of values. Therefore, alternatively, a higher-order polynomial can be adapted to obtain a continuous curve of the derivation of the directional function 522. Alternatively, for representing the directional function 522 by directional function values, the directional function 522 can also be provided as a mathematical calculation rule outputting a respective directional function value for an angle as the input value.

The directional function can be applied to physical quantities, such as the volume of an audio signal, to signal delays or audio effects in order to influence the same. Alternatively, the directional function 522 can also be used for other applications, such as in image processing or communication engineering. To this end, the apparatus 500 for generating a directional function 522 can, for example, comprise a modifier modifying the physical quantity based on the directional function 522. For this, the directional function determiner 520 can provide the directional function 522 in a format that the modifier can process. For example, directional function values are provided for equidistant angles. Then, the modifier can, for example, allocate a direction of an audio object to that directional function value that has been determined for the closest precalculated angle (angle with the smallest distance to the direction of the audio object).

For example, a determined directional function can be stored by a storage unit in the form of a lookup table and be applied, for example, to audio signals, meta data or loudspeaker signals of an object-based audio scene for causing an audio effect determined by the directional function.

An apparatus 500 for generating a directional function 522 as is shown and described in FIG. 5 can be used, for example, for providing the determined directional function of the above-described apparatus for changing an audio scene. In this context, the apparatus for generating a directional function is also referred to as directional controller or weighting controller. Further, in this example, the modifier corresponds to the control signal determiner.

In other words, an apparatus for changing an audio scene as described above can comprise an apparatus for generating a directional function. Thereby, the apparatus for generating a directional function provides the determined directional function to the apparatus for changing an audio scene.

Additionally, the graphical user interface 510 can comprise a rotation knob effecting the same change of direction for all input knobs 512 of the plurality of input knobs 512 when the same is rotated. Thereby, the direction of all input knobs 512 with respect to the reference point 514 can be changed simultaneously for all input knobs 512 and this does not have to be done separately for every input knob 512.

Optionally, the graphic user interface 510 can also allow the input of a shift vector. Thereby, the distance with respect to the reference point 514 of at least one input knob 512 of the plurality of input knobs 512 can be changed based on a direction and a length of the shift vector and the direction of the input knob 512. For example, thereby, a distance 516 of an input knob 512, whose direction with respect to the reference point 514 matches the direction of the shift vector best can be changed the most, whereas the distances 516 of the other input knobs 512 are changed less with respect to their deviation from the direction of the shift vector. The amount of change of the distances 516 can be controlled, for example, by the length of the shift vector.

The directional function determiner 520 and/or the modifier can, for example, be independent hardware units or part of a computer, microcontroller or digital signal processor as well as computer programs or software products for execution on a microcontroller, computer or digital signal processor.

Figure 6:
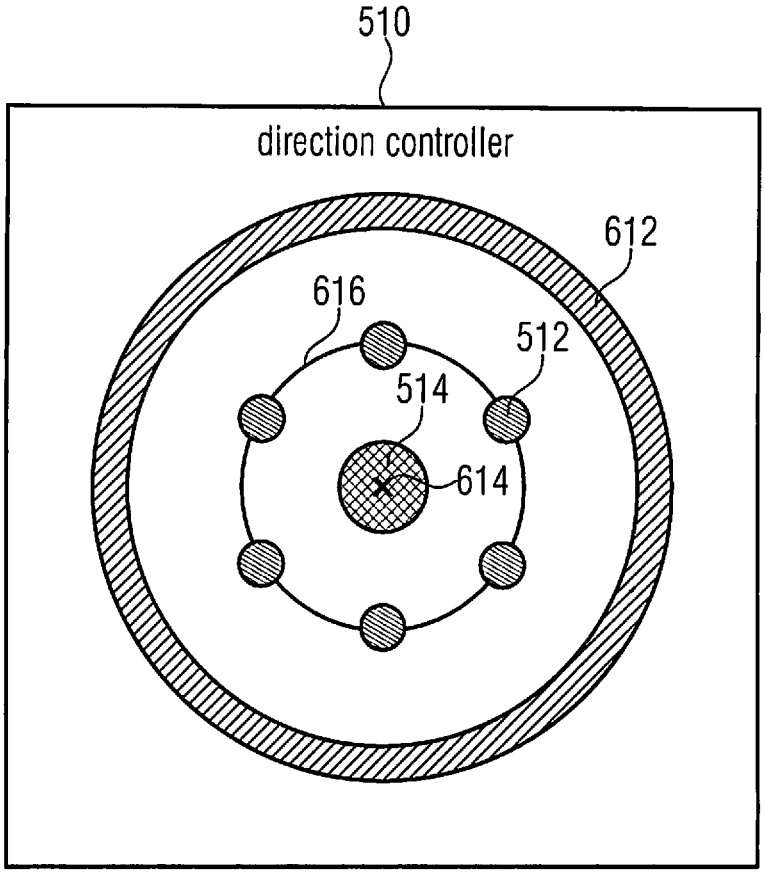
FIG. 6 a schematic illustration of a graphical user interface.

FIG. 6 shows an example for a graphical user interface 510 as a version of a weighting controller (or directional controller for direction-dependent weighting (two-dimensional).

The directional controller allows the user to specify the direction-dependent control values used in the signal processing stage (audio scene processing apparatus). In the case of a two-dimensional scene description, this can be visualized by using a circle 616. In a three-dimensional system, a sphere is more suitable. The detailed description is limited to the two-dimensional version without loss of universality. FIG. 6 shows a directional controller. The knobs 512 (input knobs) are used to define specific values for a given direction. The rotation knob 612 is used to rotate all knobs 512 simultaneously. The central knob 614 is used to emphasize a specific direction.

In the shown example, the input knobs are arranged with same distances to the reference point on the reference circle 616 in the initial position. Optionally, the reference circle 616 can be changed in its radius and, thereby, the distance of the input knobs 512 can be assigned a common distance change.

Figure 7:
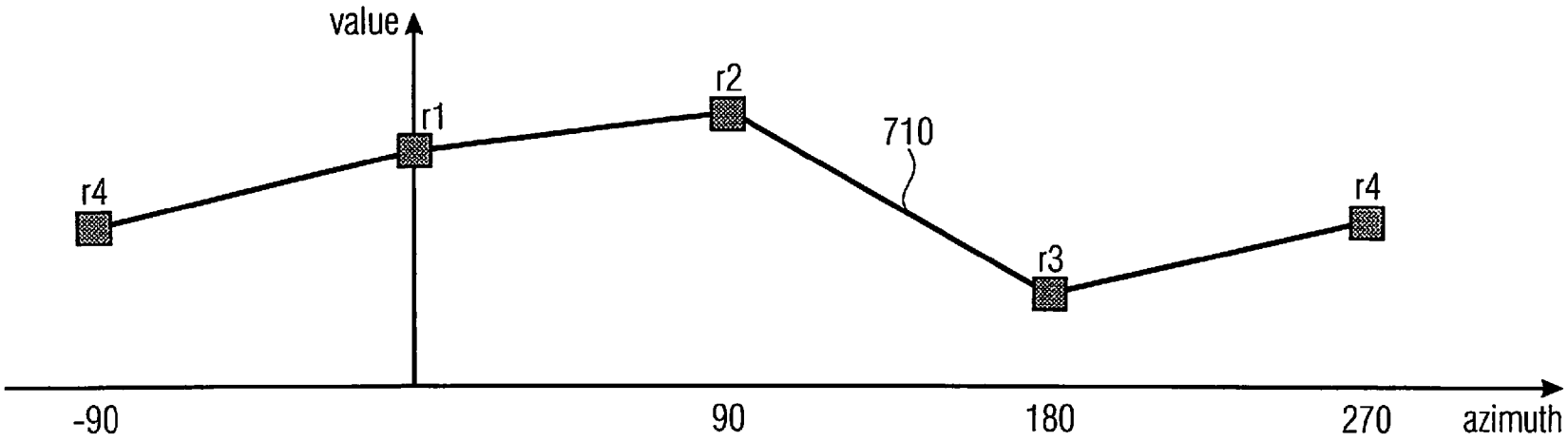
FIG. 7 an example for azimuth-dependent parameter value interpolation.

While the knobs 512 deliver specific values defined by the user, all values in between can be calculated by interpolation. If these values are given, for example, for a directional controller having four input knobs 512 for knobs $r_1$ to $t_4$ and their azimuth angle $\alpha_1$ to $\alpha_4$, an example for linear interpolation is given in FIG. 7. The rotation knob 612 is used to specify an offset $\alpha_{rot}$. This offset is applied to the azimuth angles $\alpha_1$ to $\alpha_4$ by the equation:

$$\alpha_i=\alpha_i+\alpha_{rot}, \quad \text{(Eq. 1)}$$

wherein i indicates the azimuth angle index.

The center knob can control the values $r_1$ to $r_4$ of the knobs. Depending on a displacement vector $$\vec{d}=\begin{pmatrix} x_d \\ y_d \end{pmatrix},$$

a scaling value $r_{scal}$ can be calculated using the equation:

$$r_{scal}=1+\frac{x_d+y_d}{2} \quad \text{(Eq. 2)}$$

and can be applied to the values for the specific point by $$r_i=r_i \cdot r_{scal}. \quad \text{(Eq. 3)}$$

A further possibility is the usage of the shift vector in order to emphasize a certain direction. For this, in a two-stage method, the shift vector is converted to the knobs 512. In the first step, the position vector of the knobs 512 is added with the shift vector $$\vec{r}_i^{\,t}=\vec{d}+\vec{r}_i \quad \text{(Eq. 4)}$$

In a second step, the new position of the knob $\vec{r}_i^{\,t}$ is projected to the fixed direction. This can be solved by calculating the scalar product between the shift vector and the unity vector $\vec{e}_i$ in the direction of the knob to be considered $$s_i=\vec{r}_i^{\,t}\cdot\vec{e}_i \quad \text{(Eq. 5)}$$

The value of the scalar product $s_i$ represents the new amount of the considered knob i.

The output of the directional controller is, for example, a continuous parameter function $r(\alpha)$ generated by a specific interpolation function based on the values of the knobs 512 defined by $$r(\alpha)=\text{interpol}(\alpha_1, \ldots \alpha_N), \quad \text{(Eq. 6)}$$

where N indicates the number of knobs 512 used in the controller.

As mentioned above, FIG. 7 shows an azimuth-dependent parameter value interpolation 710 as an example for a generated directional function using a graphical user interface having four input knobs each arranged at a 90° distant from each other around the reference point. The directional function can be used, for example, for calculating control values for a directional controller having four knobs using linear interpolation.

Several embodiments according to the invention are related to an apparatus and/or device for processing an object-based audio scene and signals.

Among others, the inventive concept describes a method for mastering object-based audio content without generating the reproduction signals for dedicated loudspeaker layouts. While the process of mastering is adapted to object-based audio content, it can also be used for generating new spatial effects.

Thereby, a system for simulating the production step of mastering in the context of object-based audio production is described. In an embodiment of the invention, direction-dependent audio processing of object-based audio scenes is realized. This allows abstraction of the separate signals or objects of a mixture, but considers the direction-dependent modification of the perceived impression. In other embodiments, the invention can also be used in the field of a spatial audio effect as well as a new tool for audio scene representations.

The inventive concept can, for example, convert a given audio scene description consisting of audio signals and respective meta data into a new set of audio signals corresponding to the same or a different set of meta data. In this process, an arbitrary audio processing can be used for transforming the signals. The processing apparatuses can be controlled by a parameter control.

By the described concept, for example, interactive modification and scene description can be used for extracting parameters.

All available or future audio-processing algorithms (audio scene processing apparatuses, such as a multi-channel renderer, a wave-field synthesis renderer or a binaural renderer) can be used in the context of the invention. To this end, the availability of a parameter that can be changed in real time may be necessitated.

Figure 8:
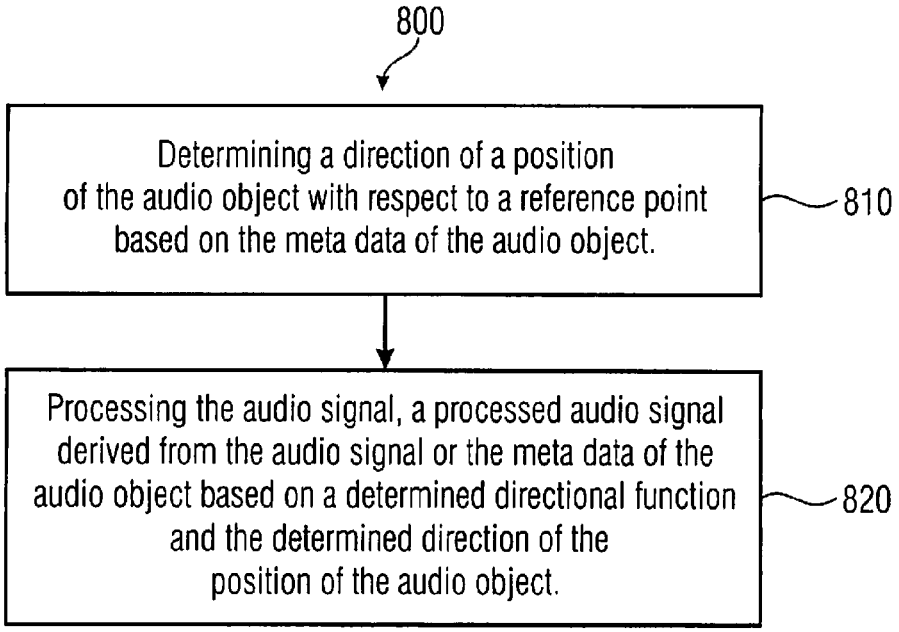
FIG. 8 a flow diagram of a method for changing an audio scene.

FIG. 8 shows a flow diagram of a method 800 for changing an audio scene corresponding to an embodiment of the invention. The audio scene comprises at least one audio object having an audio signal and associated meta data. The method 800 comprises determining 810 a direction of a position of the audio object with respect to a reference point based on the meta data of the audio object. Further, the method 800 comprises processing 820 the audio signal, a processed audio signal derived from the audio signal or the meta data of the audio object based on a determined directional function and the determined direction of the position of the audio object.

Figure 9:
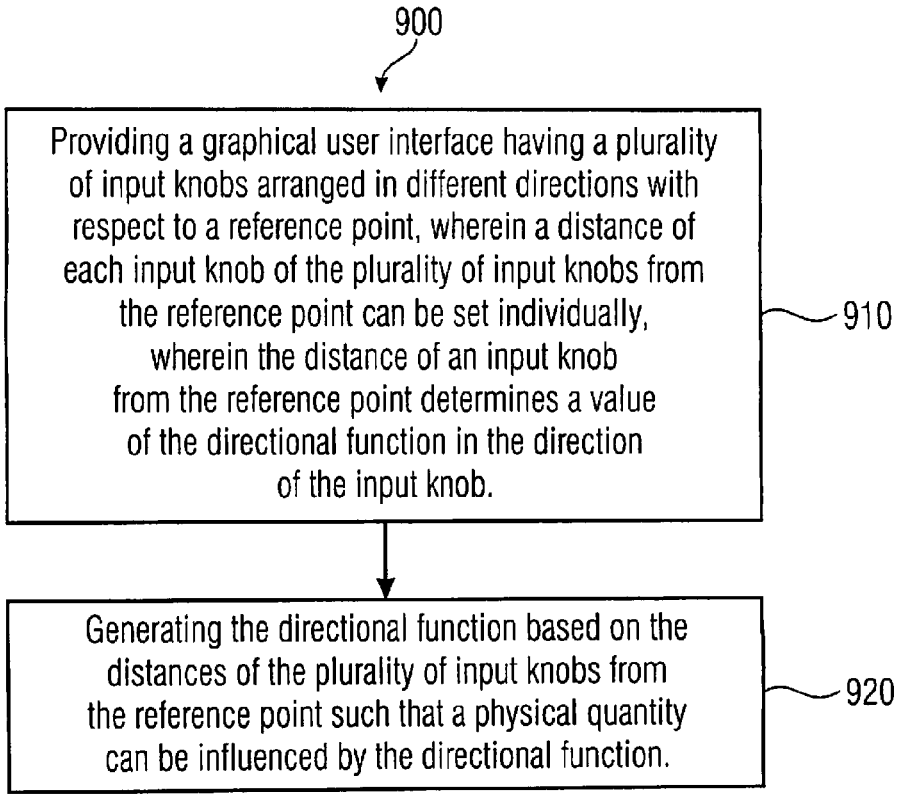
FIG. 9 a flow diagram of an apparatus for changing a directional function.

FIG. 9 shows a flow diagram of a method 900 for generating a directional function corresponding to an embodiment of the invention. The method 900 comprises providing 910 a graphical user interface having a plurality of input knobs arranged in different directions with respect to a reference point. Thereby, a distance of every input knob of the plurality of input knobs from the reference point can be individually adjusted. The distance of an input knob from the reference point determines a value of the directional function in the direction of the input knob. Further, the method 900 comprises generating 920 the directional function based on the distances of the plurality of input knobs from the reference point, such that a physical quantity can be influenced by the directional function.

Although several aspects have been described in the context of an apparatus, it is obvious that these aspects also represent a description of the respective method such that a block or a device of an apparatus can also be considered as a respective method step or a feature of a method step. Analogously, aspects described in the context of or as a method step also represent a description of a respective block or detail or feature of a respective apparatus.

Depending on certain implementation requirements, embodiments of the invention can be implemented in hardware or in software. The implementation can be performed by using a digital memory medium, for example floppy disc, DVD, Blu-ray disc, CD, ROM, PROM, EPROM, EEPROM or FLASH memory, hard drive or any other magnetic or optic memory on which electronically readable control signals are stored that can cooperate with a programmable computer system or cooperate with the same such that the respective method is performed. Thus, the digital memory medium can be computer-readable. Thus, several embodiments of the invention comprise a data carrier having electronically readable control signals that are able to cooperate with a programmable computer system such that one of the methods described herein is performed.

Generally, embodiments of the present invention can be implemented as a computer program product with a program code, wherein the program code is effective for performing one of the methods when the computer program product runs on a computer. The program code can, for example, also be stored on a machine-readable carrier.

Other embodiments comprise the computer program for performing one of the methods described herein, wherein the computer program is stored on a machine-readable carrier.

In other words, an embodiment of the inventive method is a computer program having a program code for performing one of the methods described herein when the computer program runs on a computer. Another embodiment of the inventive method is a data carrier (or a digital memory medium or a computer-readable medium) on which the computer program for performing one of the methods herein is stored.

A further embodiment of the inventive method is a data stream or a sequence of signals representing the computer program for performing one of the methods described herein. The data stream of sequence of signals can be configured in order to be transferred via a data communication connection, for example via the internet.

A further embodiment comprises a processing means, for example a computer or programmable logic device configured or adapted to perform one of the methods described herein.

A further embodiment comprises a computer on which the computer program for performing one of the methods described herein is installed.

In some embodiments, a programmable logic device (for example a field-programmable gate array, FPGA) can be used to perform some or all of the functionalities of the methods described herein. In some embodiments, a field-programmable gate array can cooperate with a microprocessor to perform one of the methods described herein. Generally, in some embodiments, the methods are performed by any hardware apparatus. The same can be universally usable hardware, such as a computer processor (CPU) or method-specific hardware, such as an ASIC.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for changing an audio scene, the audio scene comprising at least one audio object comprising an audio signal and associated meta data, the apparatus comprising:

a direction determiner implemented to determine a direction of a position of the at least one audio object with respect to a reference point based on the meta data of the at least one audio object;

a parameter selector implemented to select a parameter to be changed from the meta data of the at least one audio object;

a directional function provider implemented to provide a directional function, wherein the directional function defines, for each determined direction of a position of the at least one audio object of a plurality of different directions, a weighting factor, which indicates how heavily the parameter to be changed of the meta data of the at least one audio object, which is in the determined direction with respect to the reference point, is changed;

a control signal determiner implemented to determine a control signal for controlling an audio scene processing apparatus, wherein the control signal determiner is implemented to apply the weighting factor for the determined direction of the at least one audio object to a value of the parameter to be changed in order to determine a changed parameter value as the control signal; and the audio scene processing apparatus implemented to process the audio signal of the at least one audio object, a processed audio signal derived from the audio signal of the at least one audio object or the meta data of the audio object of the at least one audio object using the changed parameter value instead of the value of the parameter to be changed to achieve a changed audio scene.

2. The apparatus according to claim 1, wherein the audio scene processing apparatus comprises a meta data modifier implemented to replace a value of the parameter to be changed of the at least one audio object by the changed parameter value to obtain the changed audio scene having the changed parameter value instead of the value of the parameter to be changed.

3. The apparatus according to claim 1, wherein the audio scene processing apparatus comprises an audio signal modifier implemented to apply the changed parameter value, instead of the value of the parameter to be changed, to the audio signal of the at least one audio object to obtain the changed audio scene.

4. The apparatus according to claim 1, wherein the audio scene processing apparatus is implemented to use the changed parameter value, instead of the value of the parameter to be changed, when generating a plurality of loudspeaker signals to be reproduced by a loudspeaker array to obtain the changed audio scene.

5. The apparatus according to claim 1, further comprising a directional function adapter implemented to adapt a range of values of the determined directional function to a range of values of a parameter to be changed, wherein the control signal determiner is implemented to determine the control signal based on the adapted directional function.

6. The apparatus according to claim 1, implemented to change all audio objects of the audio scene or all audio objects of an audio object group of the audio scene.

7. The apparatus according to claim 1, wherein the audio scene processing apparatus is implemented to process the audio signal of the at least one audio object or the processed audio signal derived from the audio signal of the at least one audio object based on the determined directional function and the determined direction of the position of the at least one audio object in a frequency-dependent manner.

8. An apparatus for generating a directional function, comprising:

a graphical user interface comprising a plurality of input knobs arranged in different directions with respect to a reference point, wherein a distance of each input knob of the plurality of input knobs from the reference point is individually adjustable, wherein the distance of each input knob of the plurality of input knobs from the reference point determines a directional function value in the direction of the input knob with respect to the reference point; and a directional function determiner implemented to generate the directional function based on the distances of the plurality of input knobs from the reference point, such that a physical quantity can be influenced by the directional function, wherein the directional function determiner is implemented to determine, for each input knob of the plurality of input knobs, the distance of the input knob to the reference point, and to determine a functional value of the directional function based on the determined distance, the functional value being associated with the direction of the input knob with respect to the reference point, wherein the directional function determiner is implemented to calculate further functional values of the directional function for directions with respect to the reference point, in which any input knobs are not arranged, by interpolating the functional values acquired based on the distances of the plurality of input knobs to the reference point, and wherein the directional function comprises the functional values and the further functional values.

9. The apparatus according to claim 8, wherein the graphical user interface comprises a rotation knob, wherein a rotation of the rotation knob effects an equal change of the directions of all input knobs of the plurality of input knobs.

10. The apparatus according to claim 8, comprising a modifier implemented to change the physical quantity based on the directional function.

11. The apparatus according to claim 8, wherein the graphical user interface allows an input of a shift vector, wherein the distance with respect to the reference point of at least one input knob of the plurality of input knobs is changed based on a direction and a length of the shift vector and the direction of the input knob.

12. An apparatus for changing an audio scene according to claim 1 comprising an apparatus for generating a directional function, comprising: a graphical user interface comprising a plurality of input knobs arranged in different directions with respect to a reference point, wherein a distance of each input knob of the plurality of input knobs from the reference point can be individually adjusted, wherein the distance of an input knob from the reference point determines a value of the directional function in the direction of the input knob; and a directional function determiner implemented to generate the directional function based on the distances of the plurality of input knobs from the reference point, such that a physical quantity can be influenced by the directional function, wherein the directional function determiner is implemented to calculate further functional values of the directional function by interpolating functional values acquired based on the distances of the plurality of input knobs, wherein the apparatus for generating a directional function provides the determined directional function.

13. A method for changing an audio scene, the audio scene comprising at least one audio object comprising an audio signal and associated meta data, the method comprising:

determining a direction of a position of the at least one audio object with respect to a reference point based on the meta data of at least one the audio object;

selecting a parameter to be changed from the meta data of the at least one audio object;

providing a directional function, wherein the directional function defines, for each determined direction of a position of the at least one audio object of a plurality of different directions, a weighting factor, which indicates how heavily the parameter to be changed of the meta data of the at least one audio object, which is in the determined direction with respect to the reference point, is changed;

determining a control signal for controlling an audio signal processing, comprising applying the weighting factor for the determined direction of the at least one audio object to a value of the parameter to be changed in order to determine a changed parameter value as the control signal; and processing the audio signal of the at least one audio object, a processed audio signal derived from the audio signal of the at least one audio object or the meta data of the at least one audio object using the changed parameter value instead of the value of the parameter to be changed to achieve a changed audio scene.

14. A method for generating a directional function, comprising:

providing a graphical user interface comprising a plurality of input knobs arranged in different directions with respect to a reference point, wherein a distance of every input knob of the plurality of input knobs from the reference point is individually adjustable, wherein the distance of each input knob of the plurality of input knobs from the reference point determines a directional function value in the direction of the input knob with respect to the reference point;

determining, for each input knob of the plurality of input knobs, the distance of the input knob to the reference point, and determining a functional value of the directional function based on the determined distance, the functional value being associated with the direction of the input knob with respect to the reference point; and calculating further functional values of the directional function for directions with respect to the reference point, in which any input knobs are not arranged by interpolating the functional values acquired based on the distances of the plurality of input knobs to the reference point, wherein the directional function comprises the functional values and the further functional values.

15. The method of claim 14, wherein the graphical user interface comprises a rotation knob, wherein a rotation of the rotation knob effects an equal change of the directions of all input knobs of the plurality of input knobs.

16. A non-transitory storage medium having stored thereon a computer program comprising a program code for performing, when running on a computer or microcontroller, a method for changing an audio scene, the audio scene comprising at least one audio object comprising an audio signal and associated meta data, the method comprising: determining a direction of a position of the at least one audio object with respect to a reference point based on the meta data of at least one the audio object selecting a parameter to be changed from the meta data of the at least one audio object providing a directional function, wherein the directional function defines, for each determined direction of a position of the at least one audio object of a plurality of different directions, a weighting factor, which indicates how heavily the parameter to be changed of the meta data of the at least one audio object, which is in the determined direction with respect to the reference point, is changed; determining a control signal for controlling an audio signal processing, comprising applying the weighting factor for the determined direction of the at least one audio object to a value of the parameter to be changed in order to determine a changed parameter value as the control signal; and processing the audio signal of the at least one audio object, a processed audio signal derived from the audio signal of the at least one audio object or the meta data of the at least one audio object using the changed parameter value instead of the value of the parameter to be changed to achieve a changed audio scene.

17. A non-transitory storage medium having stored thereon a computer program comprising a program code for performing a method for generating a directional function, when the computer program runs on a computer or a microcontroller, the method comprising: providing a graphical user interface comprising a plurality of input knobs arranged in different directions with respect to a reference point, wherein a distance of every input knob of the plurality of input knobs from the reference point is individually adjustable, wherein the distance of an input knob of the plurality of input knobs from the reference point determines a directional function value in the direction of the input knob with respect to the reference point determining, for each input knob of the plurality of input knobs, the distance of the input knob to the reference point, and determining a functional value of the directional function based on the determined distance, the functional value being associated with the direction of the input knob with respect to the reference point and calculating further functional values of the directional function for directions with respect to the reference point, in which any input knobs are not arranged by interpolating the functional values acquired based on the distances of the plurality of input knobs to the reference point, wherein the directional function comprises the functional values and the further functional values.

18. The non-transitory storage medium according to claim 17, wherein the graphical user interface comprises a rotation knob, wherein a rotation of the rotation knob effects an equal change of the directions of all input knobs of the plurality of input knobs.

* * * * *